US009677145B2

(12) United States Patent
Coryell et al.

(10) Patent No.: US 9,677,145 B2
(45) Date of Patent: Jun. 13, 2017

(54) PRE-DIFFUSED AL—SI COATINGS FOR USE IN RAPID INDUCTION HEATING OF PRESS-HARDENED STEEL

(75) Inventors: Jason J. Coryell, Rochester Hills, MI (US); Paul J. Belanger, Lake Orion, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 1102 days.

(21) Appl. No.: 13/558,472

(22) Filed: Jul. 26, 2012

(65) Prior Publication Data

US 2013/0037178 A1 Feb. 14, 2013

Related U.S. Application Data

(60) Provisional application No. 61/522,887, filed on Aug. 12, 2011.

(51) Int. Cl.

| | |
|---|---|
| ***C21D 1/42*** | (2006.01) |
| ***C21D 1/673*** | (2006.01) |
| ***C21D 8/02*** | (2006.01) |

(52) U.S. Cl.

CPC ..... *C21D 1/673* (2013.01); *C21D 8/0284* (2013.01)

(58) Field of Classification Search

None

See application file for complete search history.

(56) References Cited

U.S. PATENT DOCUMENTS

| | | | | |
|---|---|---|---|---|
| 4,079,157 | A * | 3/1978 | Yagi | C23C 2/12 148/531 |
| 7,004,004 | B2 | 2/2006 | Arns et al. | |
| 7,832,242 | B2 | 11/2010 | Brandstatter et al. | |
| 7,938,949 | B2 | 5/2011 | Brandstatter et al. | |
| 2009/0155615 | A1 | 6/2009 | Chen et al. | |
| 2009/0320968 | A1 | 12/2009 | Boeke et al. | |
| 2011/0001337 | A1 | 1/2011 | Patschicke et al. | |
| 2011/0056594 | A1* | 3/2011 | Macherey | C23C 26/00 148/530 |
| 2011/0076477 | A1* | 3/2011 | Brandstatter | C21D 1/68 428/217 |
| 2011/0165436 | A1* | 7/2011 | Drillet | B32B 15/012 428/653 |
| 2011/0174418 | A1* | 7/2011 | Maki | C21D 8/0205 148/531 |
| 2011/0236719 | A1* | 9/2011 | Hensen | C21D 1/673 428/659 |

FOREIGN PATENT DOCUMENTS

| | | |
|---|---|---|
| CN | 102089451 A | 6/2011 |
| EP | 2045360 A1 | 4/2009 |

* cited by examiner

*Primary Examiner* — George Wyszomierski

(57) ABSTRACT

A press-hardened steel component and a method of producing the same. In one form, a workpiece that will be formed into the component includes a coating that is pre-diffused with metal from the workpiece substrate. Examples of such protective coatings may include aluminum-based coatings, as well as from aluminum and silicon combinations. The pre-diffusion of the workpiece permits it to be subjected to the high heating rate of a subsequent press hardening operation without causing localized melting or vaporization of the protective coating.

13 Claims, 13 Drawing Sheets

PRE-DIFFUSED AL—SI COATINGS FOR USE IN RAPID INDUCTION HEATING OF PRESS-HARDENED STEEL

This application claims priority to U.S. Provisional Application 61/522,887, filed Aug. 12, 2011.

BACKGROUND OF THE INVENTION

The present invention generally relates to a method of preparing precoated press-hardened steel, and more particularly to pre-diffusing or pre-alloying the coating with the iron-based substrate to enable high rate heating of the blank immediately prior to hot press forming.

Steel and related structural materials used in automobile manufacture are increasingly required to simultaneously exhibit reduced weight and enhanced crash-worthiness features. One way to produce steel capable of maximizing these hitherto conflicting goals is to use high strength press-hardened steel, where component forming and hardening operations take place within a single step. Such an approach can lead to desirable properties, such as providing structural steel parts with significant increases in strength-to-weight ratio. In press-hardening, steel strip, roll, cut pieces, blanks or related workpieces are heated to austenite temperature and then formed into a final (or near-final) shape while simultaneously being cooled into the final martensitic microstructure. Current heating methods for use with press-hardened steel include using either tunnel-style (radiant tube) furnaces or vertical box-type (electric or radiant tube) furnaces.

In one form, the steel workpiece may be pre-coated, where the coatings, such as aluminum-based ones, can be used to provide a protective layer to the underlying steel workpiece. The use of such coatings enables a simpler manufacturing process, as inert furnace atmospheres and post-forming cleaning operations may no longer be required since scale formation is eliminated. Additionally, such coatings improve barrier corrosion performance of the underlying iron-based workpiece. One particular form of such a coating is aluminum-silicon alloy (Al—Si) that, when placed on the iron-based substrate and subjected to elevated temperatures, allows the diffusion of the iron from the substrate into the coating.

Unfortunately, the slow heating rates employed during the austenitization step in traditional press hardening requires extensive furnace capacity and significant manufacturing floor space. Additionally, the ability to rapidly heat the steel blanks to relatively high temperatures (typically in excess of 880° C.) for use in press hardening has been deemed incompatible with the preferred slow heating rates of the low melting point of the coatings (where, for example, it is about 660° C. for pure aluminum or around 577° C. at the Al—Si eutectic) that are used to promote the iron diffusion into the coating as a way to avoid detrimental localized melting of the coating. Likewise, high heating rates during the blank austenitization step in press hardening needed for high-volume automotive production and related high strength-to-weight components would destroy the very coating used to provide protection to the iron-based substrate.

SUMMARY OF THE INVENTION

According to an aspect of the invention, a method of preparing a press-hardenable steel component is disclosed. The method includes forming a coated steel blank by coupling a protective coating to a steel substrate; heating the coated steel blank under a first condition such that at least a portion of iron present in the substrate diffuses into the coating, after which the coated steel blank is heated under a second condition configured to raise the coated steel blank to an austenitization temperature, forming the coated steel blank into the component while it is simultaneously being cooled or quenched on its way to becoming a hardened component. In the present context, the first and second conditions correspond to particular heating parameters in general, and heating rates and temperatures in particular. As such, the effective heating rate may be determined by both the nature of the heating device (for example, induction, furnace, laser or related configurations), as well as the temperature being manipulated, to create adequate combinations to avoid melting and damage to the coating. For example, a typical slower heating rate furnace heating approach corresponding to the second condition may take a workpiece at least two to three minutes to reach a temperature of about 900° C. with an average heating rate of about 5° C./sec to about 8° C./sec (where the initial heating rate from about room temperature tends to be much quicker, for example around 20° C./sec, such as due to the hysteresis brought on by the thermal mass). In the present context, the average heating rate takes into consideration variations in heating rate that may occur during transition periods; as such, it is representative of a nominal value associated with a particular heating method, such as furnace-based, induction-based or the like. By contrast, the heating approach of this invention corresponding to the second condition incorporates much higher heating rates (for example, between about 50° C./sec and preferably much higher, such as up to about 500° C./sec (or more), while the power input settings shall determine the peak temperature for austentization. Preferably, this second condition heating approach is achieved using an induction-based approach. Thus in one preferred form, the furnace heating approach of the first condition (which preferably corresponds to pre-diffusion of the coated steel blank) may use various temperatures and times to adequately pre-diffuse the coating. In another preferred form, an induction heating approach related to the first condition may utilize various power input settings in one or multiple steps to control the temperature at a given high heating rate to adequately pre-diffuse the coating. Other methods such as laser or resistive heating can also employ similar methods to provide adequate pre-diffusion of the coating.

According to another aspect of the present invention, a method of preparing a press-hardenable steel component from a blank made up of an iron-based substrate that has been at least partially pre-diffused into protective coating is disclosed. The method includes heating the blank under a heating rate until the blank reaches an austenitization temperature. After that, the blank is formed into the component while it is simultaneously being cooled into a hardened component. Significantly, the high heating rate applied to the blank in order to obtain the austenitization temperature is great enough that if it were applied to a blank that had not been pre-diffused, it would cause at least some melting (such as the aforementioned localized melting) of the protective coating. As with the previous aspect, one or both of the heating rate and temperature may be adjusted as a way to deliver heating power to the coated blank in a preferred, controlled manner. In the present context, a high heating rate is one that is significantly higher than those mentioned above. For example, such a high heating rate may be between about 50° C./s and 500° C./s as a way to heat the blank to an austenitization temperature for its subsequent press-hardening operations. Although the present inventors have validated heating rates only as high as 500° C./s, they are of the belief that rates as high 700° C./s are also possible with the present approach; as such, these even higher rates are deemed to be within the scope of the present invention with adequate prior pre-diffusion.

According to yet another aspect of the present invention, a method of preparing a press-hardenable steel component is disclosed. The method includes heating a workpiece comprising a protective coating coupled to a steel substrate under a first condition such that at least a portion of iron present in said substrate diffuses into said coating; heating said workpiece under a second condition sufficient to raise said workpiece to an austenitization temperature that corresponds to a heating rate such that said diffusion from said first condition avoids melt-related damage to said protective coating during said second condition; and forming said workpiece into said component. The method may additionally include cooling the component to a temperature below a martensite transformation temperature, and more particularly to a cooling rate that exceeds a critical cooling rate for such martensitic transformation.

BRIEF DESCRIPTION OF THE DRAWINGS

The following detailed description of the preferred embodiments of the present invention can be best understood when read in conjunction with the following drawings, where like structure is indicated with like reference numerals and in which.

DETAILED DESCRIPTION OF THE PREFERRED EMBODIMENTS

Figure 1:
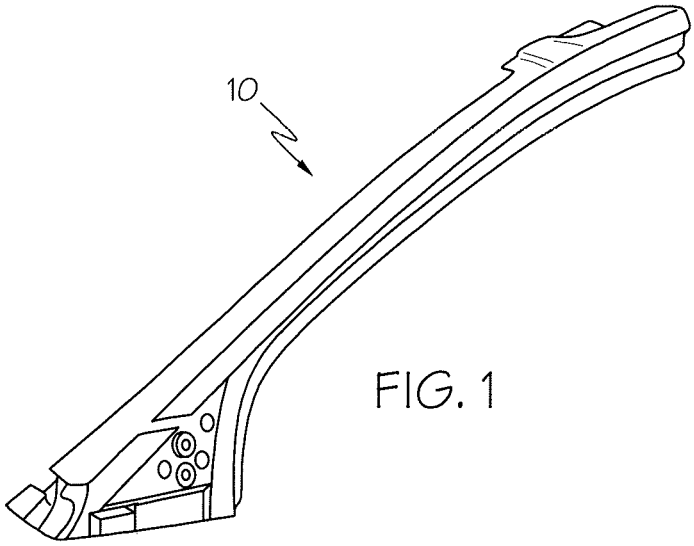
FIG. 1 shows a representative automotive A-pillar manufactured according to an aspect of the present invention.
Figure 2:
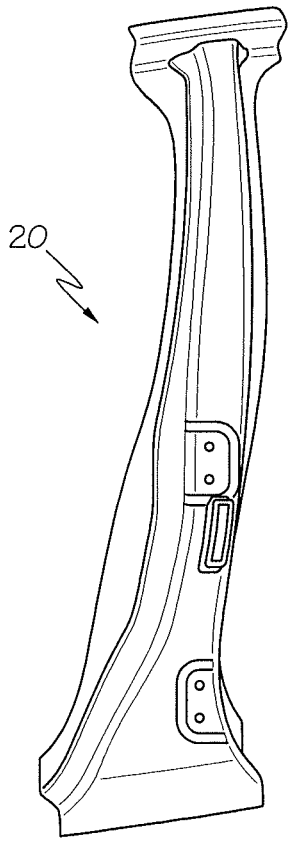
FIG. 2 shows a representative automotive B-pillar manufactured according to an aspect of the present invention.

Referring first to FIGS. 1 and 2, automotive structural components, such as the A-pillar 10 (FIG. 1) and the B-pillar 20 (FIG. 2) are shown that can be produced from a steel blank or related workpiece that is pre-diffused into a protective Al—Si coating. It will be appreciated by those skilled in the art that numerous other components may be fabricated by the present invention, and that such additional components are deemed to be within the scope of the present invention. As mentioned above, the use of such coatings on press-hardenable steel has a number of advantages over uncoated steel. In addition to providing an additional measure of corrosion-resistant benefits as a barrier coating, subsequent cleaning operations following hot stamping to remove scale from the die surfaces and parts are not necessary. Furthermore, the resulting final part dimensional performance may be kept to within smaller nominal tolerances. Moreover, the increased use of press hardened steel with pre-coated substrates in conjunction with high rate induction heating processes could reduce new furnace capital expenditure; this in turn enables more rapid turnaround to meet changes in press-hardened steel demand. Induction heating blanks may also offer lower operating costs by either eliminating combustible gas usage or increased electric efficiency (in situations where electric furnaces may still be employed).

Figure 3:
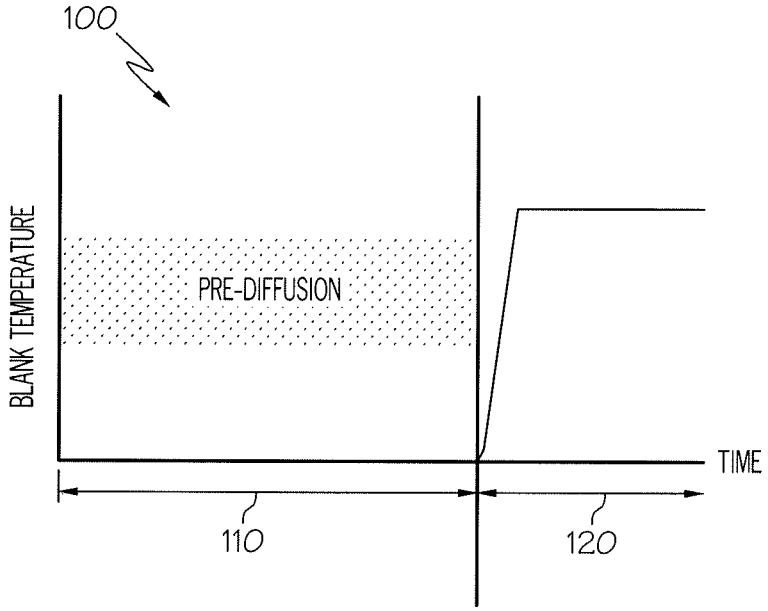
FIG. 3 shows a schematic chart depicting a way to achieve pre-diffusion via furnace heating (left side) coupled with austenitization heating via induction (right side) according to an aspect of the present invention.
Figure 4:
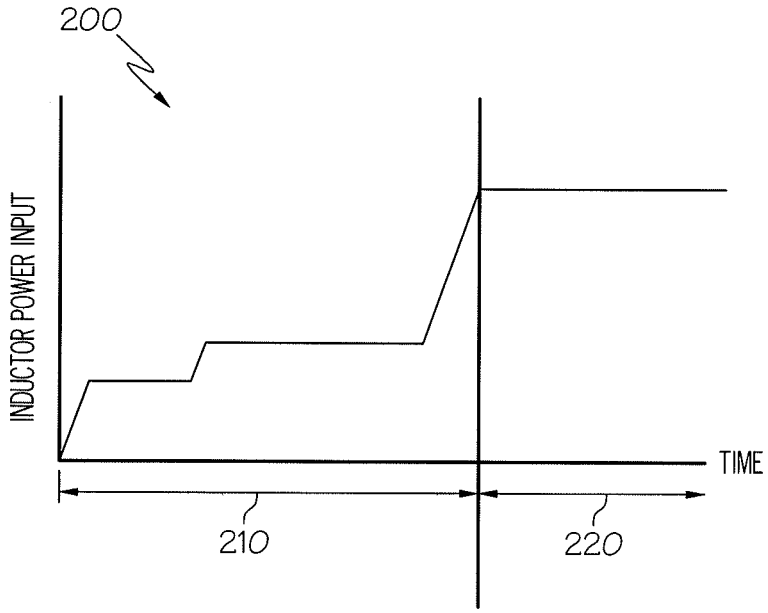
FIG. 4 shows a schematic chart depicting inductor power input versus time as a way to achieve inductor-based pre-diffusion (left side) along with austenitization heating (right side) according to another aspect of the present invention.

Referring next to FIGS. 3 and 4, two methods according to the present invention are shown in which heating for press-hardened steel is used to achieve both pre-diffusion between a steel substrate and a protective coating, as well as the necessary microstructure change prior to subsequent high rate heating during press hardening to form a part (such as A-pillar 10 and B-pillar 20 discussed above). As such, these two methods form a part of an overall press-hardening operation (as will be discussed in more detail below). In a first method 100 shown in FIG. 3, a furnace heating process or a traditional galvannealing-type low power heating may be used to establish the necessary pre-diffusion step 110 of a workpiece, blank or the like. This is followed by a higher heating power austenitization step 120 at the time of part manufacturing. In a preferred embodiment, this heating is achieved through a heating device, while in an even more particular embodiment, the heating device is an induction-based device. The induction-based approach is particularly well-suited for in-line production at a steel manufacturing facility in a manner similar to traditional galvannealing processing. As shown, the temperature of the blank may be permitted to return to a lower (for example, ambient) temperature between the pre-diffusion step 110 and the austenitization step 120. Such an approach may be employed in situations where the pre-diffusion is done at a period in time (for example, in an offline process) prior to the press hardening. In a second method 200 as shown in FIG. 4, pulse heating may be applied during the blank heating to deliver a low power pulse (or multi-pulse with increasing power input) for pre-diffusion step 210; this is followed by high power heating for the full blank heating and austenitization step 220. As is clearly shown, the first step 210 may be made up of various sub-steps corresponding to varying levels of power output (and concomitant heating rate, temperature or both). Such sub-stepped approach may be used to control heating rates and temperature as a way to avoid melting of the coating, including reversion to lower or ambient temperatures prior to subsequent austenitization of the workpiece. As with method 100, the high power portion of method 200 may employ high-efficiency heating protocols, such as induction heating. Because it is likely that the same induction equipment will be performing the first (pre-diffusion) and second (austenitization) conditions, it is possible that there is no intermediate reversion to the ambient (or related low temperature) condition depicted in FIG. 3. Nevertheless, and even in configurations where the same induction equipment is used for both conditions, the process may opt to include such a reversion (not shown); moreover, such a reversion may be applied during any step, as well as between the first and second conditions.

Induction heating is a technique commonly used in surface hardening, through-hardening, and tempering of steel by utilizing eddy current and hysteresis losses induced in the steel by alternating magnetic fields. The two fundamental mechanisms of induction heating involve energy dissipation via the Joule effect and energy losses associated with magnetic hysteresis, where the first mechanism is the primary way that carbon steels are heated. In general, the steel is heated in the first mechanism by coupling a part with an inductor coil through which a high frequency alternating current is passed. The resulting electromagnetic field around the coil induces eddy currents in the surface layer of the specimen, causing it to be heated via the Joule effect:

$$H=I^2R$$

where H is the heat per unit time, I is the induced current, and R is the electrical resistance. No contact is made between the workpiece and the induction coil, and the applied heat is restricted to localized area adjacent to the coil. The second mechanism involves heating ferromagnetic steels below their Curie temperature. Molecular friction is induced as the magnetic dipoles are reversed by the alternating frequency, resulting in a certain amount of hysteresis. The energy required to reverse the dipoles is dissipated as heat, subsequently heating the workpiece. The heat produced is therefore proportional to the rate of reversal, or the frequency of the alternating current. When the Curie temperature is reached, this mechanism will no longer contribute to heating the workpiece. In general, this second mechanism doesn't contribute as much to the induction heating as that of the Joule effect mentioned above. It will be appreciated by those skilled in the art that induction heating may be used for various pre-diffusion steps 110, 210 and austenitization steps 120 and 220 shown in FIGS. 3 and 4, respectively. For example, pre-diffusion step 110 may incorporate induction in situations where the galvannealing-type process is employed.

Besides induction heating, resistive heating, laser heating, or conventional furnace heating may be used in either a batch process (when the workpiece is a discrete blank) or a continuous process (when the workpiece is in a continuous coil form) to achieve the necessary pre-diffusion step 110, 120 of FIGS. 3 and 4. Regardless of which of these approaches are used, the common feature is that the protective coatings (such as Al—Si coatings) are pre-diffused so that the high rate heating that is attendant to the austenitization step 120, 220 immediately prior to hot press forming may be employed without risk of damage to the coating. As mentioned above, it is advantageous to use a high rate heating approach for the second portion of the blank or workpiece heating, and that induction heating has been shown to be particularly capable in this regard, as it may employ heating rates that exceed those of conventionally-known furnace heating.

Figure 5:
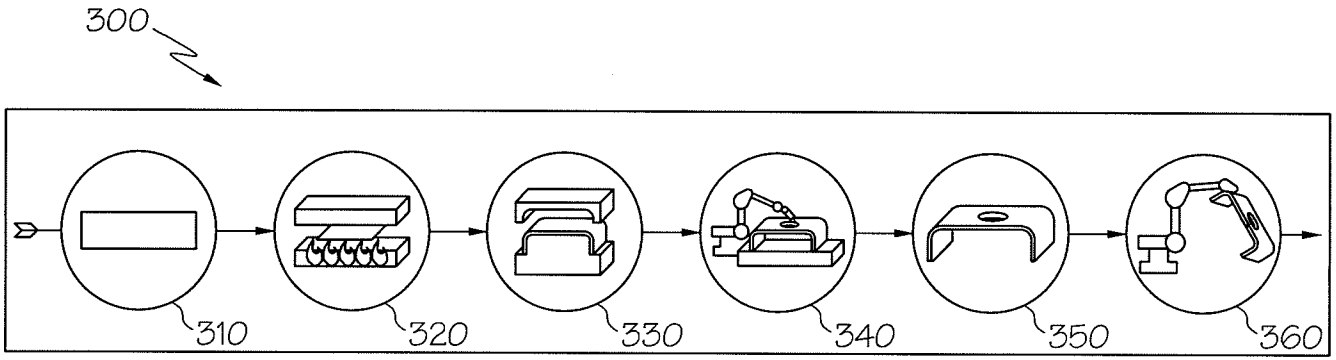
FIG. 5 (PRIOR ART)
FIG. 5 shows a conventional way of furnace heating an Al—Si coated iron-based substrate blank where no pre-diffusion is used according to the prior art.

Referring next to FIG. 5, a flowchart showing the steps of a conventional press-hardening approach 300 according to the prior art is shown. In it, an Al—Si-coated iron-based substrate is first blanked 310, and then subjected to furnace heating 320 to austenitization temperatures. From there, it is hot-formed 330, after which trimming 340 and optional cleaning 350 are then performed on the fabricated component, after which it is sent for subsequent assembly 360.

Figure 6:
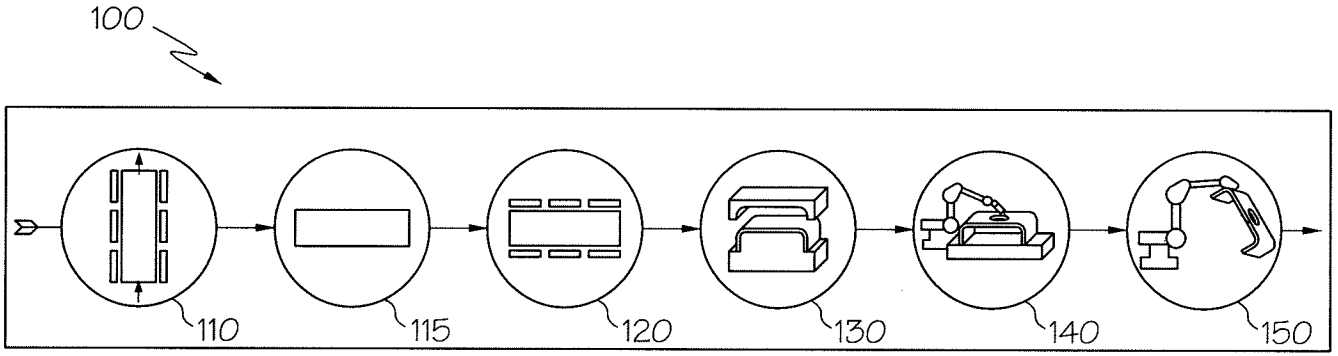
FIG. 6 shows a first way of enabling high rate heating of a pre-diffused or pre-alloyed iron-based substrate blank immediately prior to hot press forming according to an aspect of the present invention.
Figure 7:
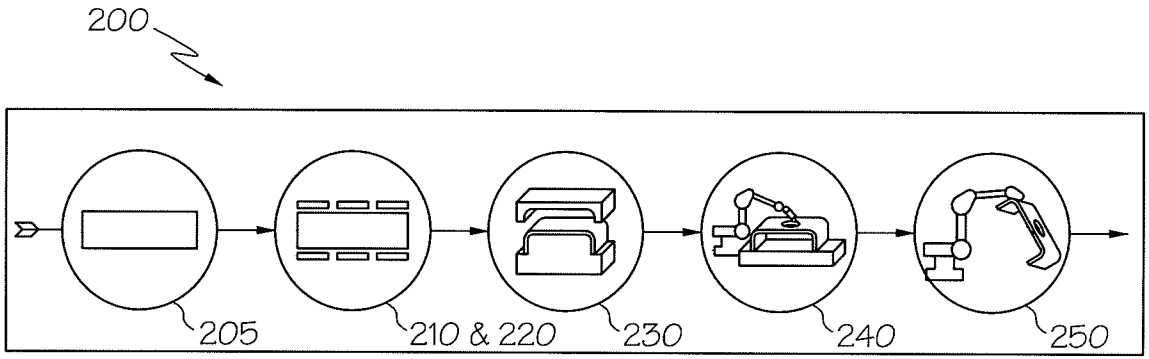
FIG. 7 shows a second way of enabling high rate heating of a pre-diffused or pre-alloyed iron-based substrate blank immediately prior to hot press forming according to an aspect of the present invention.
Figure 8:
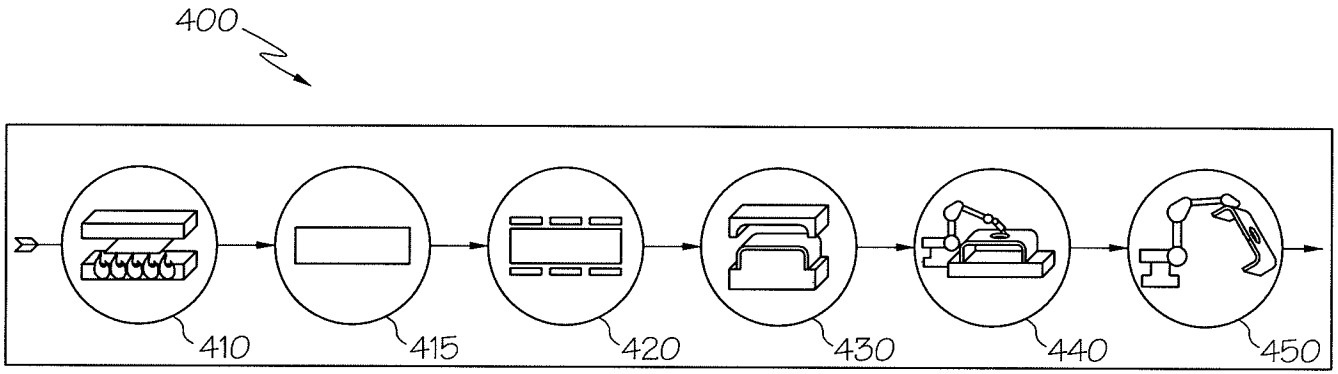
FIG. 8 shows a third way of enabling high rate heating of a pre-diffused or pre-alloyed iron-based substrate blank immediately prior to hot press forming according to an aspect of the present invention.

Referring next to FIGS. 6 though 8, flowcharts showing the steps of various embodiments of the present invention are shown. Unlike the conventional press-hardening approach 300 of FIG. 5, the methods depicted in FIGS. 6 through 8 show the use of heating (also referred to herein as a "first heating condition", or more simply a "first condition") as a way to achieve pre-diffusion of the iron from the substrate into the protective coating prior to austenitization (also referred to herein as a "second heating condition", or more simply a "second condition") and hot forming. As mentioned above, by having some of the iron from the workpiece be pre-diffused into the Al—Si (or related) coating, the coating melting point increases, making it better able to accommodate the high heating rates from the austenitization heating station or other second condition that would otherwise cause melting or related damage to the coating. This in turn can be used to speed up the overall heating process thereby minimizing the required furnace capacity and the associated manufacturing floor space.

Referring with particularity to FIG. 6, in one form, an in-line heating process 100 may be used such that the Al—Si coating application (for example, through hot-dipping followed immediately by strip heating) may be incorporated into a component-forming operation at a steel mill. By way of example, as with traditional Zn—Fe alloying to create galvanized steel, a steel strip is passed through a series of inductor coils to heat the strip in a first condition continuously under a pre-diffusion step 110 similar to that depicted in FIG. 3. In a preferred form, the temperature of the Al—Si or related coating is exposed to in this first condition is kept below its melting point to avoid severe melting, beading, or loss of coating integrity. After the in-line heating under the pre-diffusion step 110, the workpiece is blanked 115 and then subjected to an austenitization step 120, this latter step similar to that depicted in FIG. 3. In a preferred form, this latter step is by induction heating to temperatures sufficient in the second condition to ensure that the blank becomes austenitized. From there, it is hot-formed 130, after which trimming 140 is then performed prior to being sent for assembly 150. Significantly, separate cleaning steps are not required, as residual scale from the hot stamping die surfaces is substantially eliminated.

Referring with particularity to FIG. 7, approach 200 shows additional steps based on the heating method depicted in FIG. 4, where the pre-diffusion step 210 may take place after blanking 205. In this form, a workpiece containing a coating that has not yet been pre-diffused may be delivered to the part manufacturer for subsequent pre-diffusion, austenitization and hot stamping in one continuous operation. In a preferred form, the pre-diffusion 210 and austenitization 220 steps utilize controllable heating equipment, such as those employed with induction heating, to effectively pre-diffuse the coating to avoid melting prior to subsequent austenitization 220 and hot stamping 230. In one particular form, the austenitizing takes place to a temperature of about 880° C. or higher. As with approach 100 depicted in FIG. 6, the approach 200 of FIG. 7 includes (in addition to the aforementioned hot-forming 230), trimming 240 and assembly 250 steps.

Referring with particularity to FIG. 8, as mentioned above, other heating methods may be employed that are used to make up approach 400. For example, furnace heating, laser heating or the like may be used (all shown as pre-diffusion step 410), where (in the furnace example) temperatures exceeding 600° C. (slow furnace heating rates) for 10 minutes minimum shall produce an adequate diffusion layer for subsequent high rate heating. At temperatures exceeding 800° C., minimum heat treating times for adequate pre-diffusion is 2 minutes. Thus, it is generally similar to the approach 100 discussed above in conjunction with FIGS. 3 and 6 (approach 100) with the way in which the pre-diffusion step 410 takes place. As stated above, it is important to avoid using pre-diffusion temperatures that would subject the protective coating to melting, beading or related damaging conditions. Nevertheless, it will be appreciated by those skilled in the art that combinations of times and exposure temperatures may be applied such that even if one of the heating parameters (such as heating rate or temperature) are exceeded, their use taken together is such that melt-related damage is avoided, and that such time and temperature manipulation is deemed to be within the scope of the present invention.

Figure 9:
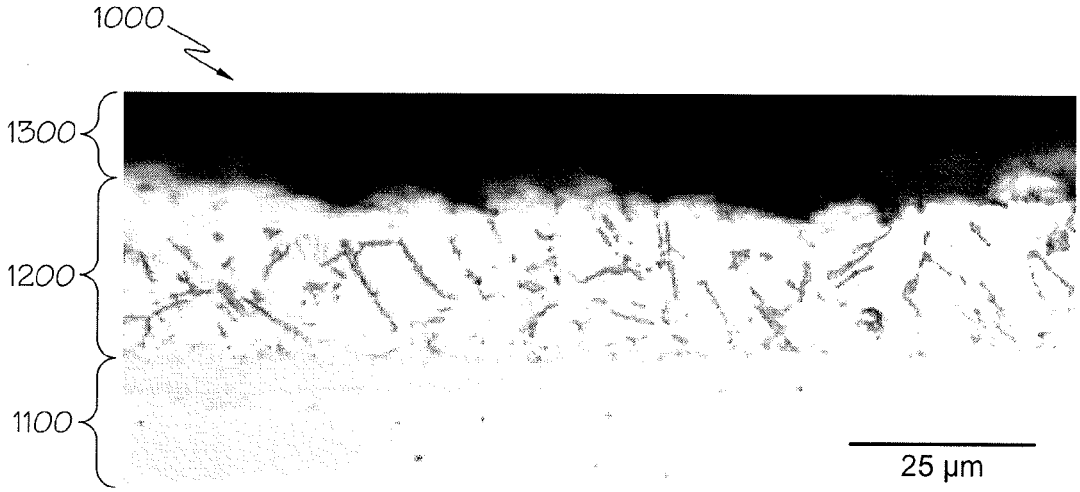
FIG. 9 (PRIOR ART)
FIG. 9 shows an example of an Al—Si coated steel workpiece according to the prior art that is incapable of being heated at high rates.
Figure 10:
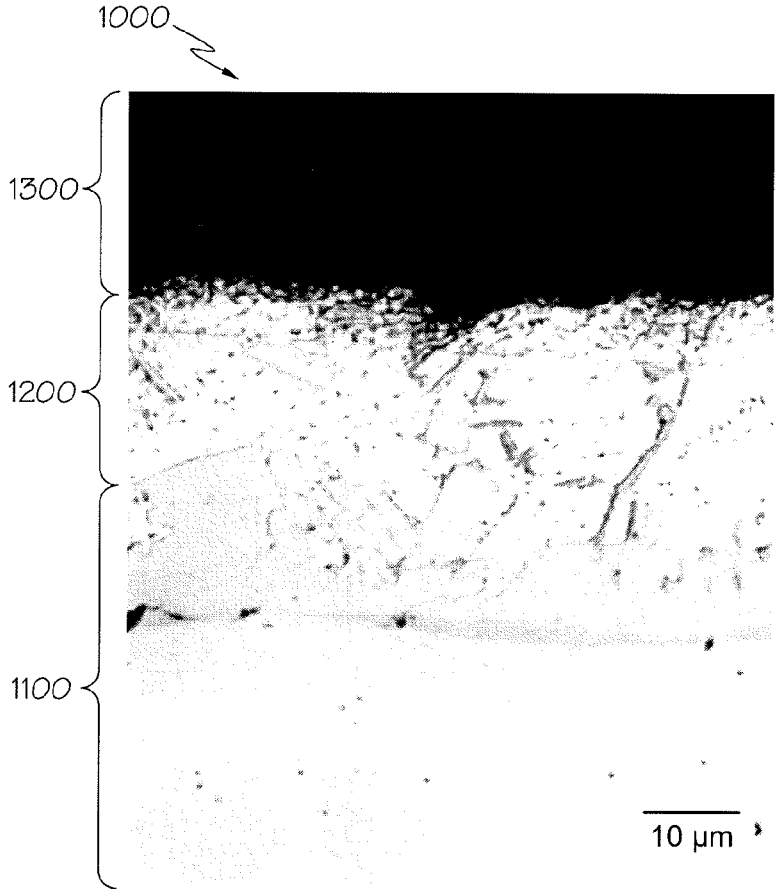
FIG. 10 (PRIOR ART)
FIG. 10 shows an example of the coating of FIG. 9 that has not been sufficiently pre-diffused prior to heating.
Figure 11A:
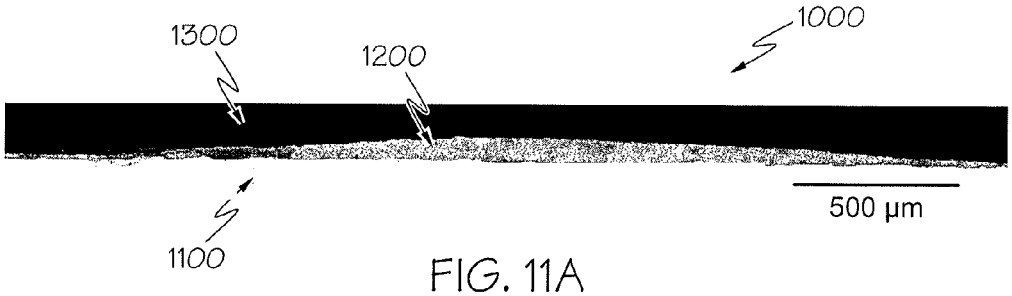
FIG. 11A (PRIOR ART)
FIGS. 11A and 11B show evidence of severe melting and beading of the coating of FIG. 10.
Figure 11B:
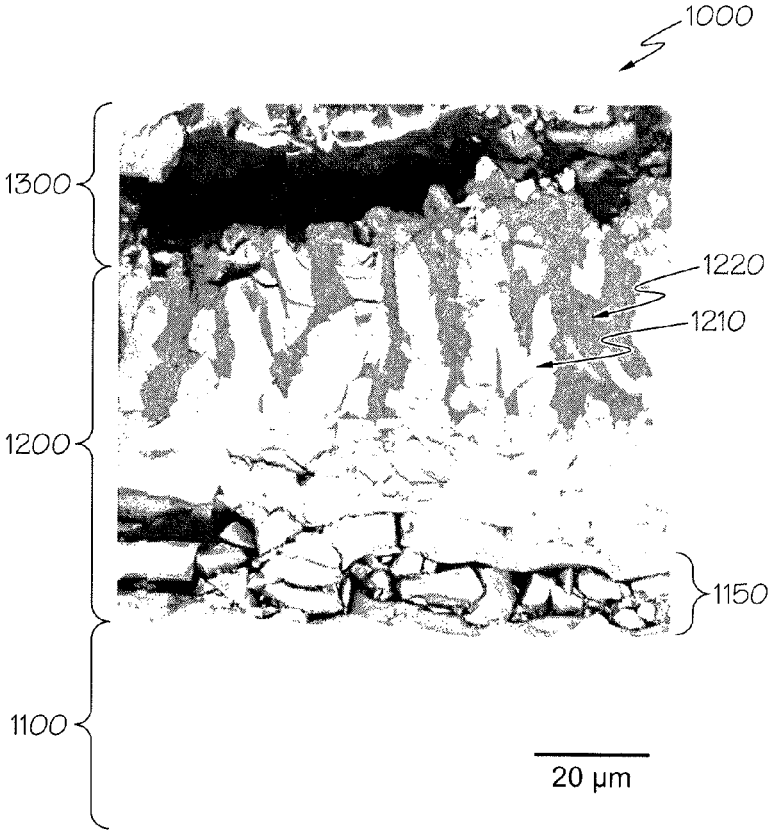
FIG. 11B (PRIOR ART)

Referring next to FIGS. 9, 10, 11A and 11B, a light optical micrograph (LOM) is shown of an as-coated steel of a sample workpiece 1000 made according to the prior art, where an Al—Si coating composition with a eutectic melting point of about 577° C. is used in a subsequent hot stamping process. This coating, without a pre-diffusion process, is incapable of being heated at high heating rates to typical austentization temperatures (for example, about 880° C. to 950° C.) for use in conjunction with hot stamping in press-hardened steel applications. The LOM shows—from the bottom up—a substrate layer 1100 and a coating layer 1200. A mounting epoxy 1300 is also shown, although this last feature is merely used as a mounting surface for the formation of the sample and does not form a part of the finished sample workpiece 1000. Referring with particularity to FIGS. 10, 11A and 11B, the pre-diffused sample workpiece 1000 of FIG. 9 was created with a furnace heat treatment of 700° C. for 2 minutes. Following this, the sample workpiece 1000 was heated at 500° C. per second in a Gleeble® 3500 thermomechanical simulator to 950° C. and held for 10 seconds to simulate a high rate heating process (such as induction hardening) to be used in the hot stamping process. After high rate heating, the sample workpiece 1000 was cooled with 20 psi compressed air at a rate of between 100° C./sec and 350° C./sec between 950° C. down to 400° C. While it will be appreciated by those skilled in the art that cooling rates are slower in actual hot stamping operations (which are typically around 60° C./sec), the present simulation conducted by the inventors was not used to quantify the effects of actual cooling rates, but instead to determine if such a coating could survive the heating process without appreciable melt-related damage. As shown in the LOM image in FIG. 11A, severe melting and beading of the coating layer 1200 on the surface was evident based on the surface appearance and uneven coating on the sample workpiece 1000 surface; the present inventors concluded that this was indicative of inadequate pre-diffusion prior to high rate heating. Referring with particularity to FIG. 11B, the resulting cross-section backscattered secondary electron (BSE) image from within the subsequently solidified coating layer of 11A is shown. Furthermore, there is evidence in the BSE of an undesirable columnar structure, shown by the alternating light and dark areas 1210 and 1220; such structure is indicative of melting and resolidification with varying chemical compositions. Moreover, this structure was accompanied by a loss of coating integrity at the interface between the coating layer 1200 and the substrate 1100, as indicated by region 1150. The present inventors believe that this beading also produced the uneven coating shown in the representative cross-section in FIG. 11A. Visual evidence of phases from the Al—Si eutectic system in FIG. 9 and FIG. 10 may likewise be gleaned from the present figures for situations where a non pre-diffused (or an insufficiently pre-diffused) Al—Si coating is formed, where the mixed compositions will include portions that are the last to solidify on cooling and the first to melt on heating at the eutectic temperature; this is shown by a significant presence of coating layer 1200 in FIG. 9 (one prior to any heat treatment, or pre-diffusion). Stated another way, the coating layer 1200 in FIG. 9 shows evidence of the sort of phases inherent in an Al—Si eutectic system (with its low melting point of 577° C.) that the present inventors seek to avoid.

Figure 12A:
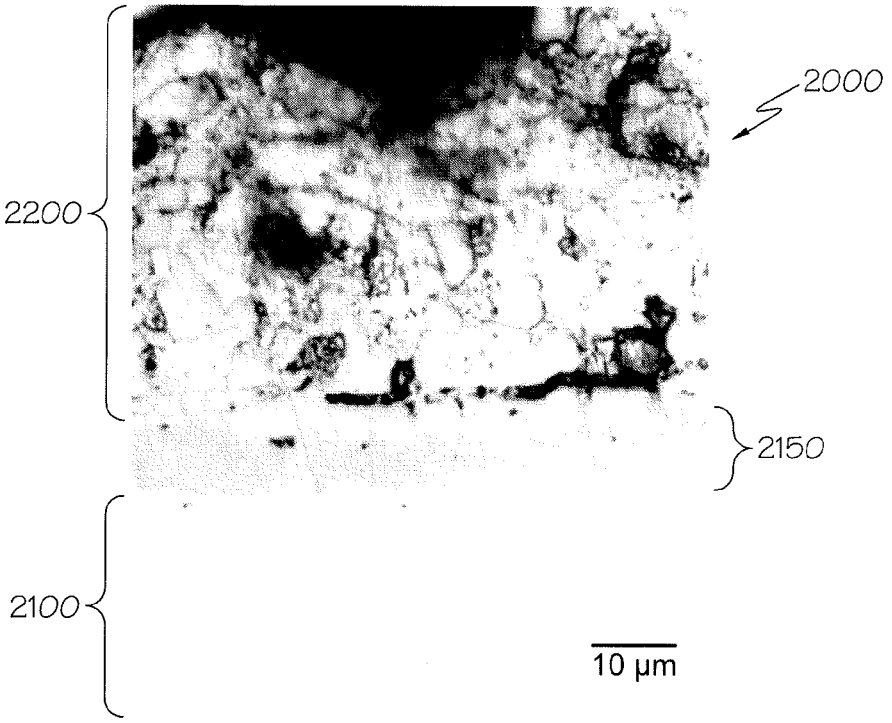
FIGS. 12A, 13A and 14A show representative examples of pre-diffused coating conditions that are able to be subsequently heated at high rates according to the present invention.
Figure 12B:
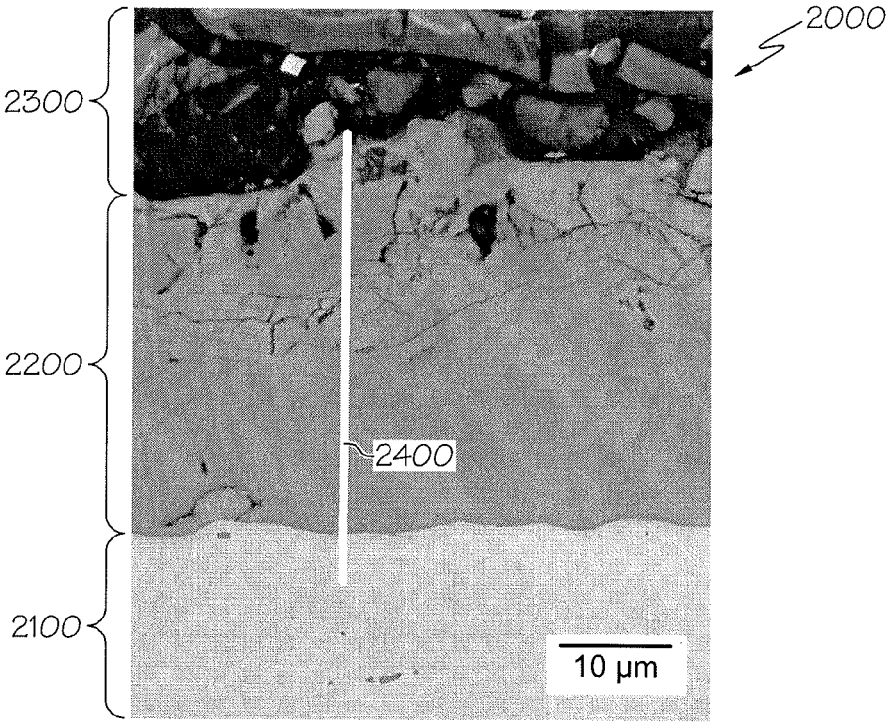
FIGS. 12B, 13B and 14B show the coatings of respective FIGS. 12A, 13A and 14A following subsequent high rate heating.
Figure 12C:
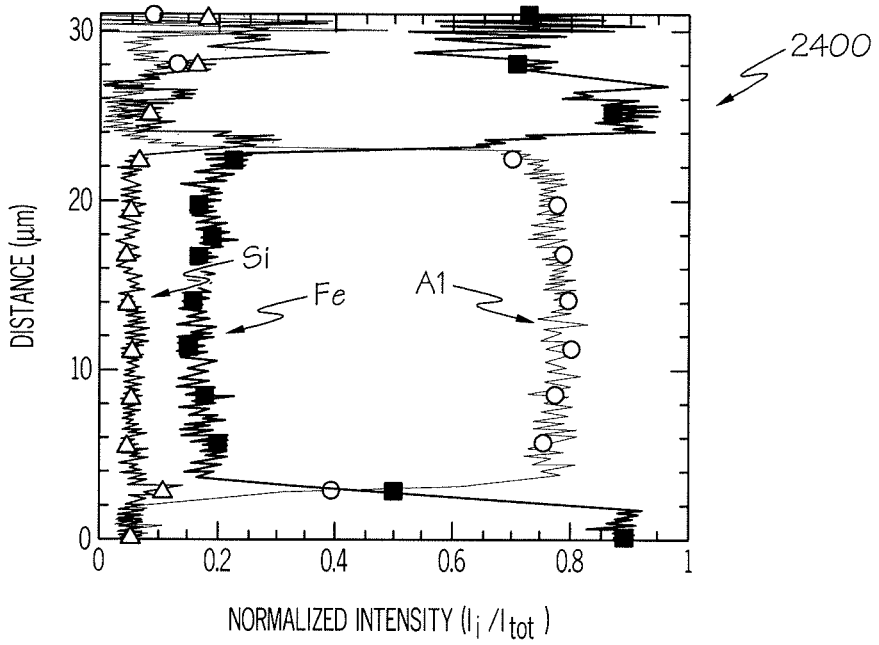
FIGS. 12C, 13C and 14C show the representative composition maps of the coatings of respective FIGS. 12B, 13B and 14B.

Referring next to FIGS. 12A through 12C, the results of a pre-diffusion process according to the present invention is shown, where the pre-diffusing parameters include a furnace heating at 600° C. for 10 minutes. Referring with particularity to FIG. 12A, a representative LOM cross-section of a sample workpiece 2000 with a pre-diffused coating layer 2200 is shown, where distinct alloy layers are present throughout. The intermediate layer 2150 is the first interdiffusion layer between the substrate 2100 and the coating 2200 and includes an extremely high Fe content. As such, this intermediate layer 2150 makes up a part of the layered structure of workpiece 2000. Following this pre-diffusion treatment, the sample workpiece 2000 was heated at 500° C. per second in a Gleeble® 3500 thermomechanical simulator to 950° C. and held for 10 seconds to simulate a high rate heating process so that the workpiece 2000 can be subsequently formed in a hot stamping process. After high rate heating, the workpiece 2000 was cooled with compressed air in the manner discussed above. Referring with particularity to FIG. 12B, the resulting cross-section BSE image shows relatively uniform composition of coating layer 2200. This compositional uniformity is verified by a semi-quantitative analysis using Energy Dispersive Spectroscopy (EDS) with an EDAX Genesis detector with EDAX Spectrum Software version 6.32, shown with a line scan 2400 to produce the corresponding result in FIG. 12C. This white scan line in FIG. 12B corresponds to the positioning and distance denoted in FIG. 12C. Using an automated quantification procedure in the software, the composition was found to be approximately 46% Fe, 50% Al, and 4% Si (likely $Fe_2Al_5$). No evidence of severe melting or beading of the coating layer 2200 was observed. As above, a mounting epoxy 2300 is also shown.

Figure 13A:
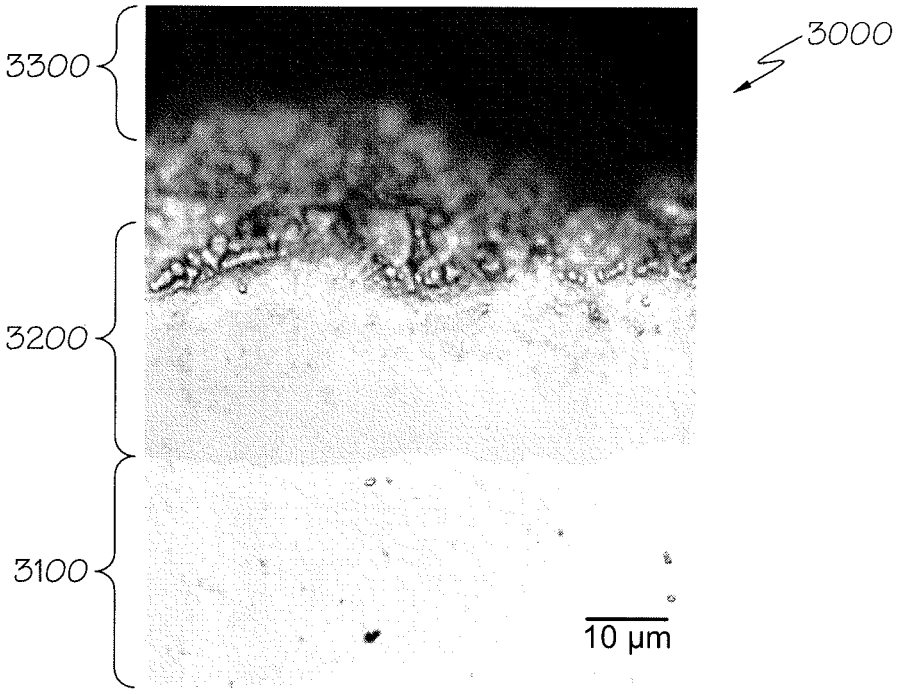
Figure 13B:
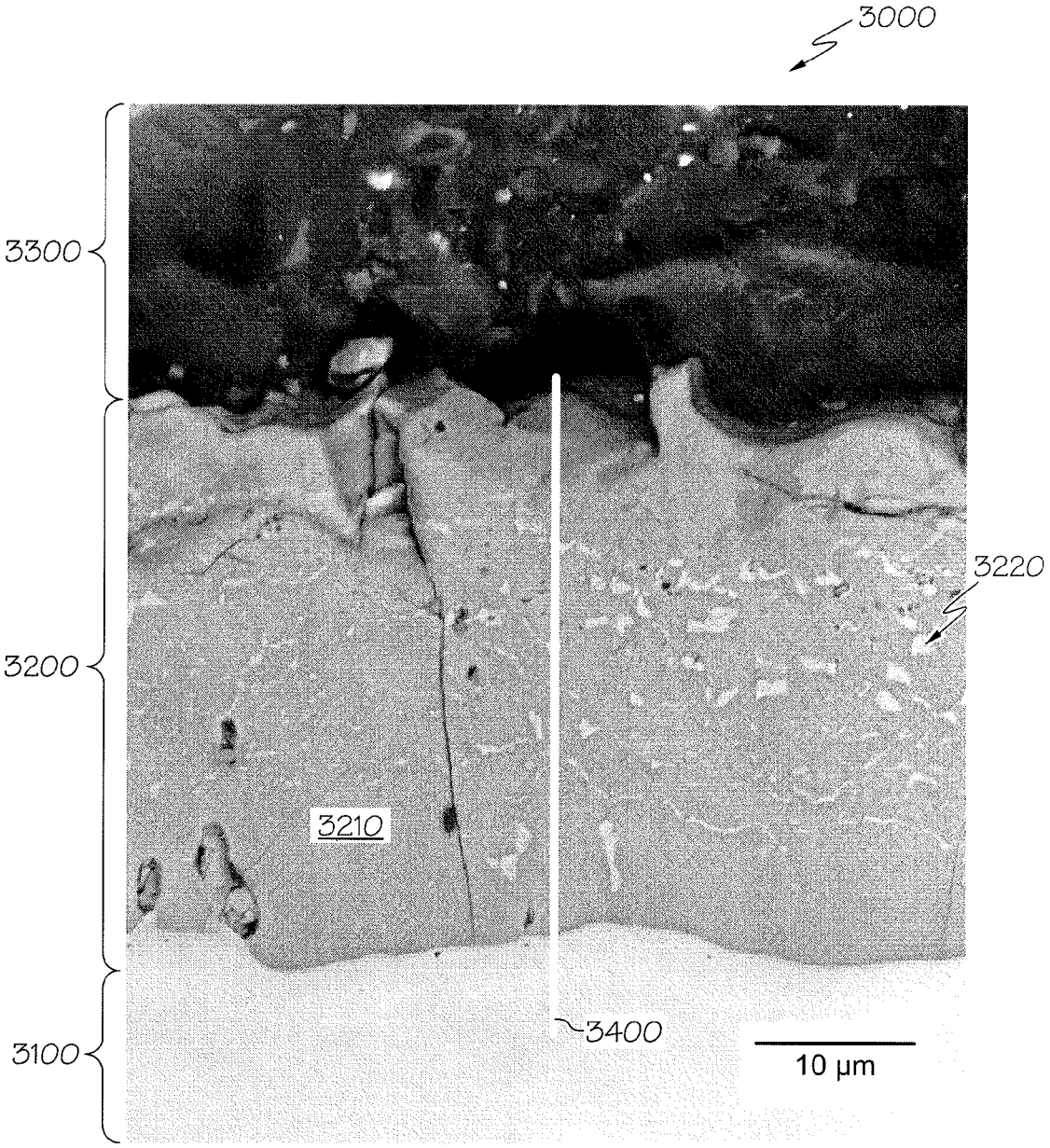
Figure 13C:
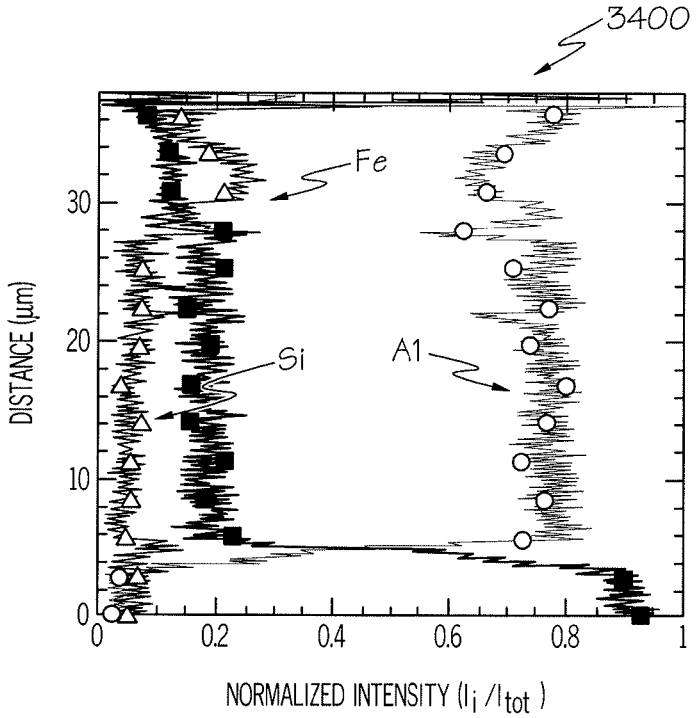

Referring next to FIGS. 13A through 13C, another sample workpiece 3000 with adequate pre-diffusion process parameters is shown. In it, the pre-diffusing was via furnace heating at 600° C. for 30 minutes. A representative LOM cross-section of the pre-diffused coating layer 3200 is shown with particularity in FIG. 13A on top of substrate 3100, where very little of the Al—Si eutectic (i.e., the lowest melting point in Al—Si binary system) remains and the coating layer 3200 is sufficiently alloyed with Fe. This lack of eutectic is particularly evident when compared to the significant Al—Si eutectic structure presence in the LOM cross-sections of FIG. 9 or FIG. 10, where little or no pre-diffusion was employed. Following this pre-diffusion treatment, the workpiece 3000 was heated at 500° C. per second in a Gleeble® 3500 thermomechanical simulator to 950° C. and held for 10 seconds to simulate a high rate heating process (such as the aforementioned induction hardening) to be used as part of the hot stamping process. After high rate heating, the workpiece was cooled from 950° C. to 400° C. with 20 psi compressed air at a rate between 100° C. and 350° C. per second. In FIG. 13B, the resulting cross-section BSE image shows relatively uniform coating composition 3210 with small regions consisting of a different composition 3220. Significantly, the coating layer 3200 survives these processing conditions. As with the specimen sampled in FIGS. 12A through 12C, this sample workpiece 3000 was verified by a semi-quantitative analysis using EDS with the aforementioned EDAX Genesis detector with EDAX Spectrum Software to produce line scan 3400 (which is generally similar to line scan 2400 discussed above in conjunction with FIGS. 12B and 12C) with composition results shown in FIG. 13C. Using an automated quantification procedure in the Spectrum Software, the composition was found to be approximately 46% Fe, 50% Al, and 4% Si (likely $Fe_2Al_5$) in region 3210 and 61% Fe, 26% Al, and 1% Si in the smaller regions 3220 appearing lighter in color in FIG. 12B. No evidence of severe melting or beading of the coating was observed, as the coating was uniform in thickness across the surface with similar cross-sectional appearance shown in FIG. 13B. Moreover, the coating layer 3200 displayed an absence of the columnar structure in FIG. 10, thereby indicating a dearth of melting or resolidification. As discussed above, a mounting epoxy 3300 is also shown.

Figure 14A:
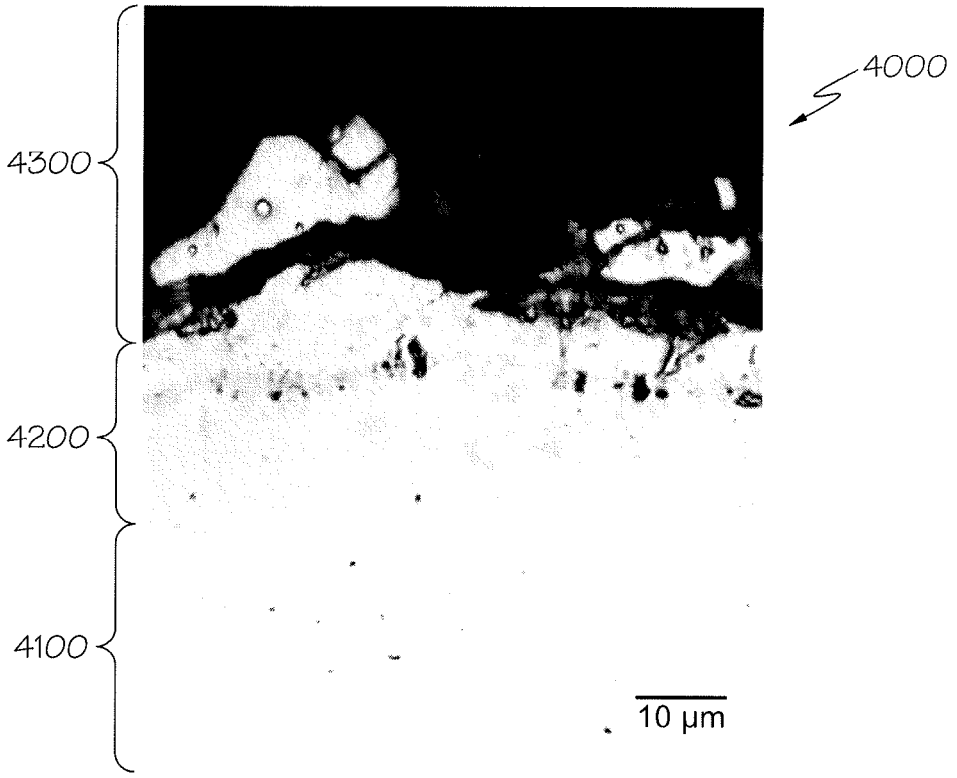
Figure 14B:
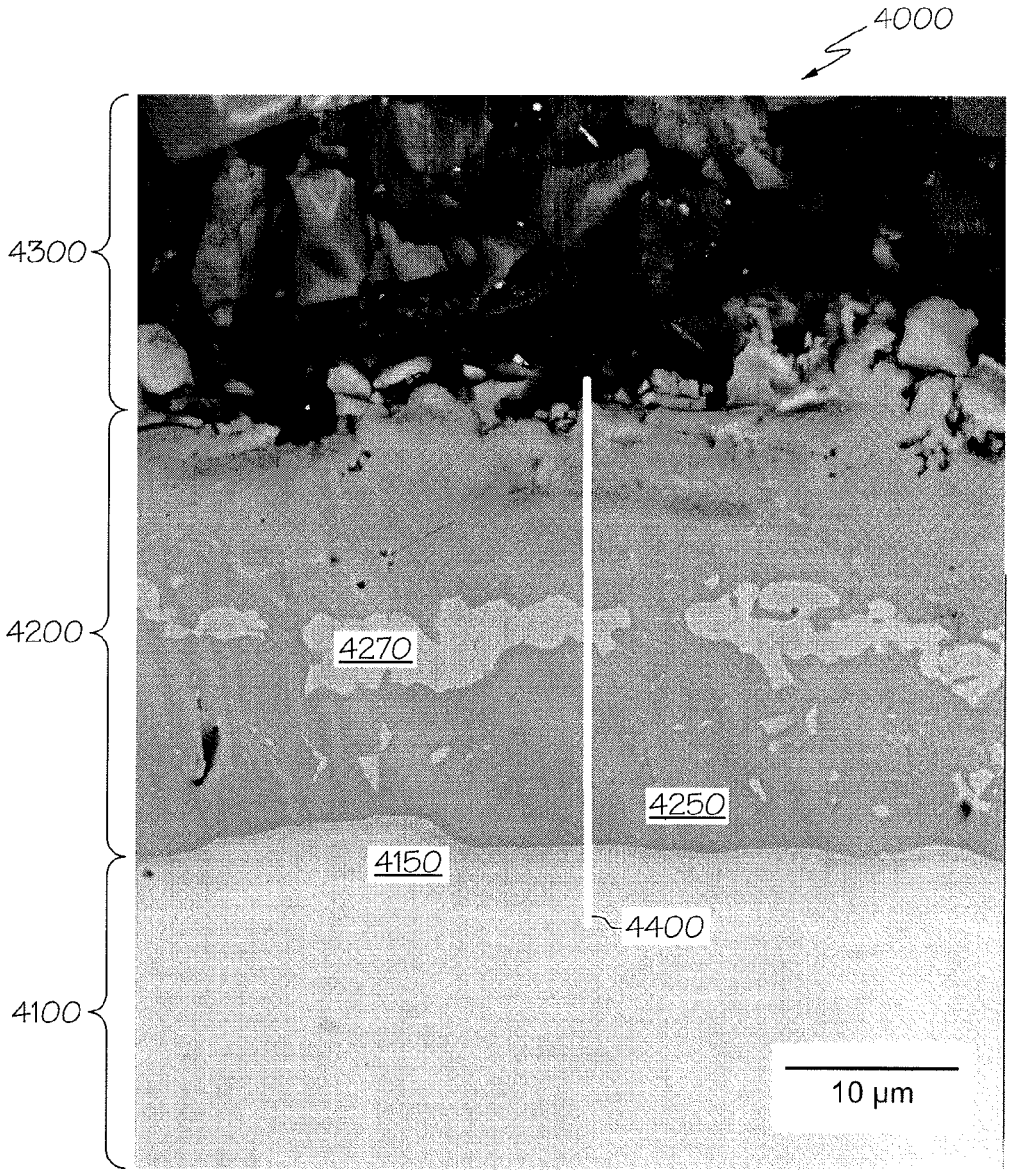
Figure 14C:
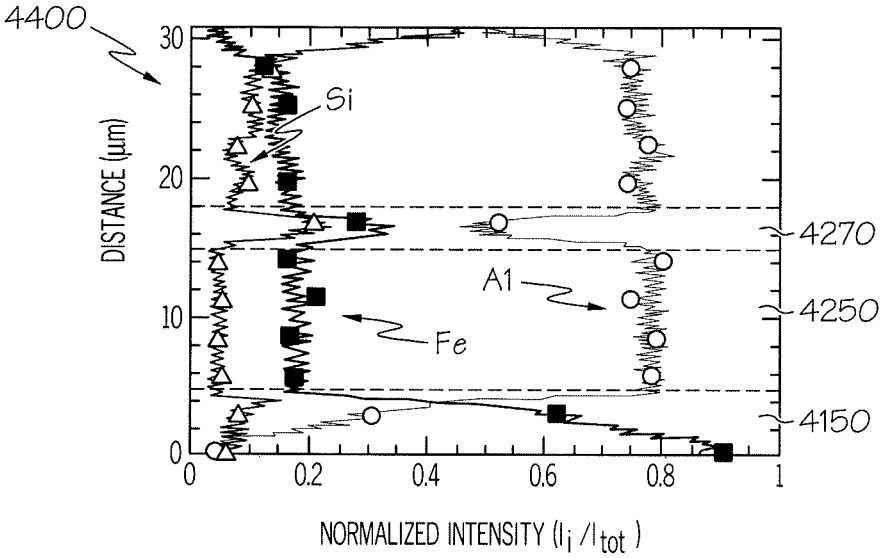

Referring next to FIGS. 14A through 14C, evidence of the present inventors having established adequate pre-diffusion process parameters by pre-diffusing yet another sample workpiece 4000 via furnace heating at 700° C. for 10 minutes is shown. A representative LOM cross-section of the pre-diffused coating 4200 is shown in FIG. 14A, where no evidence of the Al—Si eutectic remains after the pre-diffusion treatment, indicating the coating is sufficiently alloyed with iron in the underlying substrate 4100. Following this pre-diffusion treatment, the sample workpiece 4000 was heated at 500° C. per second in a Gleeble® 3500 thermomechanical simulator to 950° C. and held for 10 seconds as discussed above in conjunction with workpiece 3000. By way of example, such a high heating rate process may include induction hardening that is used as part of the hot stamping process. After high rate heating, the sample workpiece 4000 was cooled with 20 pounds per square inch (psi) compressed air at a rate between 100° C./sec and 350° C./sec between 950° C. and 400° C. In FIG. 14B, the resulting cross-section backscattered electron image shows three distinct areas of interest with different compositions (represented by regions 4150, 4250 and 4270). This was verified by a semi-quantitative analysis using EDS with the EDAX Genesis detector and Spectrum Software discussed above, the results of which are shown in FIG. 14C based on line scan 4400 in FIG. 14B that is similar to the line cans 2400 and 3400 discussed above. The profiles show a shift from an iron-rich interdiffusion layer 4150 as a result of the growth of the coating layer 4200 into the substrate 4100 to region 4250 that is aluminum rich with a composition of approximately 46% Fe, 50% Al, and 4% Si (most likely in the form of $Fe_2Al_5$). Lighter area coloring in region 4270 is rich in Fe and Si with an approximate composition of 61% Fe, 26% Al, and 13% Si. No evidence of severe melting or beading of the coating layer 4200 was observed, based on coating uniformity in thickness and lack of a columnar structure representing melting and resolidification.

Figure 15A:
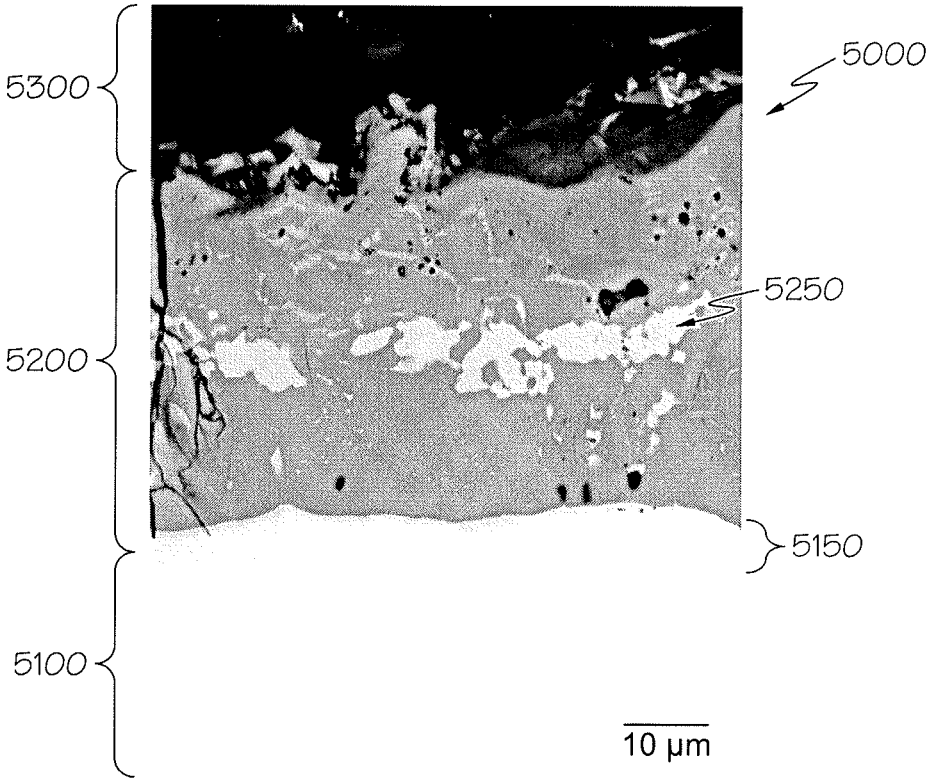
FIGS. 15A through 15C show additional representative examples of adequately pre-diffused coatings and subsequently heated at high rates according to the present invention.
Figure 15B:
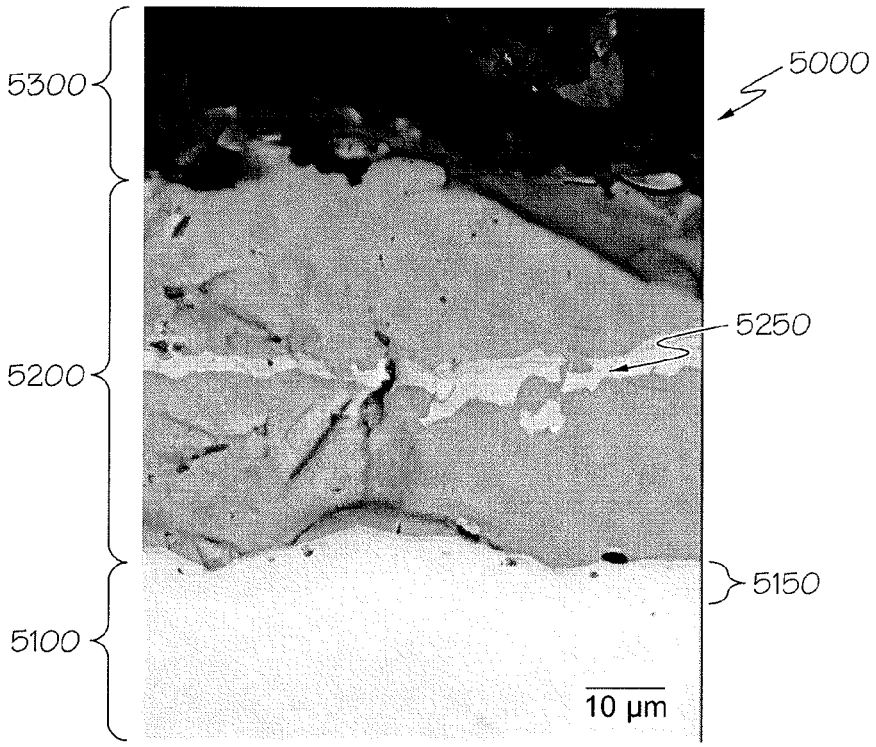
Figure 15C:
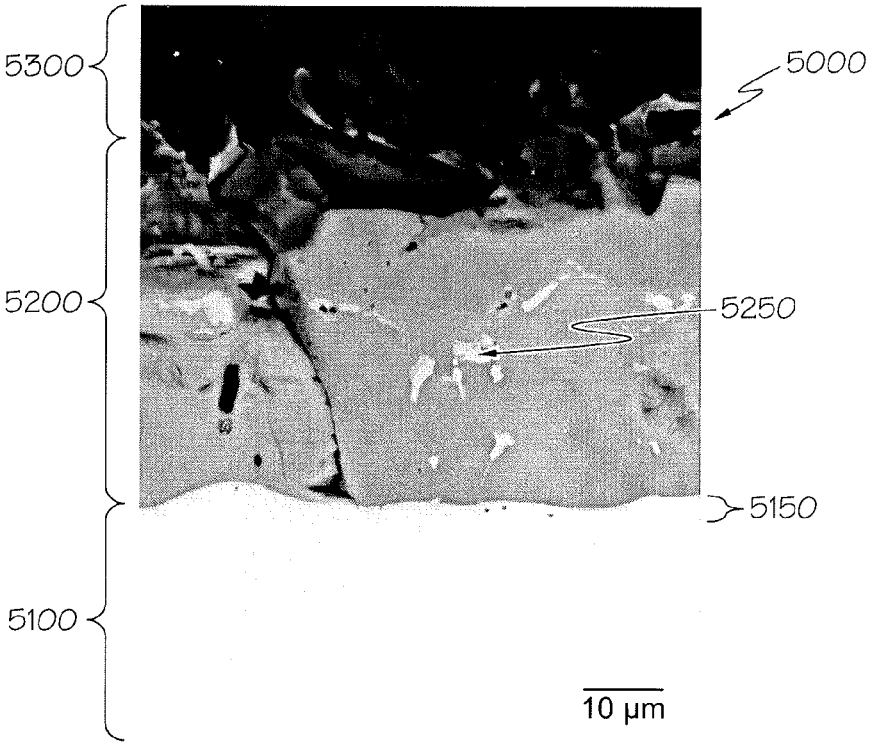

Referring next to FIGS. 15A through 15C, backscattered electron images following the respective pre-diffusion conditions 800° C. (for 2 and 10 minutes) and 900° C. (for 2 minutes) and subsequent high rate heating are shown for still another sample workpiece 5000. In them, a relatively broad diffusion layer 5150 (approximately 3 to 4 microns in thickness) is shown being formed at the interface between substrate 5100 and coating layer 5200, with a matrix of 46% Fe, 50% Al, and 4% Si (likely $Fe_2Al_5$), while a band 5250 of Fe and Si rich constituent of similar 61% Fe, 26% Al, and 13% Si is also in evidence. Once the Fe and Si solubility is exceeded in the matrix, Fe and Si precipitates of various sizes likely form depending on the amount of iron enrichment during pre-diffusion and subsequent high rate heating. Pre-diffusion furnace heat treatment conditions of 800° C. (for 2 and 10 minutes) and 900° C. (for 2 minutes) yielded similar results with those above with no evidence of severe melting or beading of the coating observed, based on coating uniformity in thickness and lack of a columnar structure.

The foregoing detailed description and preferred embodiments therein are being given by way of illustration and example only; additional variations in form or detail will readily suggest themselves to those skilled in the art without departing from the spirit of the invention. Accordingly, the scope of the invention should be understood to be limited only by the appended claims.

What is claimed is:

1. A method of preparing a press-hardenable steel component, said method comprising:

forming a coated steel blank by coupling a protective coating comprising an Aluminum-Silicon alloy to a steel substrate;

heating said coated steel blank using induction heating under a first condition such that at least a portion of iron present in said substrate diffuses into said protective coating such that the protective coating includes from about 40 weight percent to about 50 weight percent Iron and a minimum of an eutectic Aluminum-Silicon of the Aluminum Silicon alloy remains;

thereafter heating said coated steel blank using induction heating under a second condition configured to raise the temperature of said coated steel blank to an austenitization temperature; and forming said coated steel blank into said component while substantially simultaneously cooling said coated steel blank.

2. The method of claim 1, wherein said second condition corresponds to a higher temperature than that of said first condition.

3. The method of claim 1, wherein said second condition corresponds to a higher heating rate than that of said first condition.

4. The method of claim 3, wherein said first condition results in a temperature in said protective coating of no more than about 950 degrees Celsius with a heating rate of equal to or less than 20 degrees Celsius per second.

5. The method of claim 1, wherein said austenitization temperature is at least about 880 degrees Celsius.

6. The method of claim 1, further comprising holding said formed component in a forming die until a martensite transformation temperature attained in said component.

7. The method of claim 6, wherein a cooling rate associated with said cooling exceeds critical cooling rate for martensitic transformation.

8. The method of claim 1, wherein at least a portion of said heating under said first condition is by the group consisting of induction heating, resistive heating, laser heating and furnace heating.

9. The method of claim 1, wherein said component is an automotive component.

10. The method of claim 1 wherein heating said coated steel blank under a first condition such that at least a portion of iron present in said substrate diffuses into said protective coating such that the protective coating includes from about 40 weight percent to about 50 weight percent Iron and a minimum of an eutectic Aluminum-Silicon of the Aluminum Silicon alloy remains further comprises heating said coated steel blank under a first condition such that at least a portion of iron present in said substrate diffuses into said protective coating such that the protective coating includes about 46 weight percent Iron and a minimum of eutectic Aluminum-Silicon remains.

11. A method of preparing a press-hardenable steel component, said method comprising:

heating a workpiece comprising a protective coating of an Aluminum-Silicon alloy coupled to a steel substrate under a first condition such that at least a portion of iron present in said substrate diffuses into said protective coating such that the protective coating includes from about 40 weight percent to about 50 weight percent Iron predominately in the form of $Fe_2Al_5$ and wherein the first condition comprises heating the workpiece at a rate of about 25 degrees Celsius per second;

heating said workpiece under a second condition sufficient to raise said workpiece to an austenitization temperature that corresponds to a heating rate such that said diffusion from said first condition avoids melt-related damage to said protective coating during said second condition and wherein said second condition comprises heating the workpiece at a rate of about 500 degrees Celsius per second; and forming said workpiece into said component.

12. The method of claim 11, further comprising cooling said component to a temperature below a martensite transformation temperature.

13. The method of claim 11 wherein heating a workpiece comprising a protective coating coupled to a steel substrate under a first condition such that at least a portion of iron present in said substrate diffuses into said protective coating such that the protective coating includes from about 40 weight percent to about 50 weight percent Iron further comprises heating a workpiece comprising a protective coating coupled to a steel substrate under a first condition such that at least a portion of iron present in said substrate diffuses into said protective coating such that the protective coating includes about 46 weight percent Iron.

* * * * *